US009273537B2

(12) United States Patent
Riisem

(10) Patent No.: US 9,273,537 B2
(45) Date of Patent: Mar. 1, 2016

(54) SYSTEM AND METHOD FOR SAND AND INFLOW CONTROL

(71) Applicant: Schlumberger Technology Corporation, Sugar Land, TX (US)

(72) Inventor: Edvin Eimstad Riisem, Sandnes (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 264 days.

(21) Appl. No.: 13/714,009

(22) Filed: Dec. 13, 2012

(65) Prior Publication Data

US 2014/0014357 A1 Jan. 16, 2014

Related U.S. Application Data

(60) Provisional application No. 61/671,872, filed on Jul. 16, 2012.

(51) Int. Cl.
*E21B 43/08* (2006.01)
*E21B 43/12* (2006.01)

(52) U.S. Cl.
CPC ..... *E21B 43/08* (2013.01); *E21B 43/084* (2013.01); *E21B 43/12* (2013.01)

(58) Field of Classification Search
CPC ..... E21B 43/08; E21B 43/084; E21B 43/086; E21B 43/088
See application file for complete search history.

(56) References Cited

U.S. PATENT DOCUMENTS

| | | | | |
|---|---|---|---|---|
| 5,113,935 | A * | 5/1992 | Jones et al. | 166/51 |
| 6,561,732 | B1 * | 5/2003 | Bloomfield et al. | 405/43 |
| 6,681,854 | B2 | 1/2004 | Danos | |
| 6,745,843 | B2 | 6/2004 | Johnson et al. | |
| 7,559,375 | B2 | 7/2009 | Dybevik et al. | |
| 7,814,973 | B2 * | 10/2010 | Dusterhoft et al. | 166/227 |
| 7,866,383 | B2 * | 1/2011 | Dusterhoft et al. | 166/227 |
| 8,011,438 | B2 | 9/2011 | Edwards et al. | |
| 8,146,662 | B2 | 4/2012 | Shoemate | |
| 8,256,510 | B2 * | 9/2012 | Holderman et al. | 166/227 |
| 8,919,435 | B2 * | 12/2014 | Greci et al. | 166/227 |
| 2006/0237197 | A1 * | 10/2006 | Dale et al. | 166/378 |

(Continued)

FOREIGN PATENT DOCUMENTS

WO 2012135587 A2 10/2012

OTHER PUBLICATIONS

International Search Report and Written Opinion mailed on Sep. 25, 2013 for International Patent Application No. PCT/US2013/049015, filed on Jul. 2, 2013, 14 pages.

(Continued)

*Primary Examiner* — Kenneth L Thompson
(74) *Attorney, Agent, or Firm* — Patrick Traister; Jeffery Peterson

(57) ABSTRACT

A system and methodology utilizes a technique for filtering sand. For example, a sand control system may be provided with a base pipe having a non-permeable section and a permeable section in which the permeable section is created via at least one opening formed laterally through a wall of the base pipe. The sand control system also comprises at least one drainage tube positioned along an exterior of the base pipe and coupled to the base pipe in fluid communication with the at least one opening. The drainage tube is permeable and enables the inflow of fluid while preventing the influx of sand. The inflowing fluid is delivered along an interior of the drainage tube and through the opening into an interior of the base pipe for production.

20 Claims, 7 Drawing Sheets

(56) References Cited

U.S. PATENT DOCUMENTS

| | | | | |
|---|---|---|---|---|
| 2008/0035330 | A1* | 2/2008 | Richards | 166/228 |
| 2010/0059232 | A1 | 3/2010 | Langlais et al. | |
| 2010/0258300 | A1 | 10/2010 | Shoemate | |
| 2011/0247813 | A1 | 10/2011 | Moen | |

OTHER PUBLICATIONS

Leak-Off Tube Constructed of Sintered Mesh, published Apr. 4, 2011 on IP.com, publication identifier IPCOM000205879D. http://priorartdatabase.com/pubView/IPCOM000205879D.

* cited by examiner

SYSTEM AND METHOD FOR SAND AND INFLOW CONTROL

CROSS-REFERENCE TO RELATED APPLICATION

The present document is based on and claims priority to U.S. Provisional Application Ser. No. 61/671,872, filed Jul. 16, 2012, incorporated herein by reference.

BACKGROUND

In many hydrocarbon wells, well fluid passes through a sand screen which filters out particulates from the inflowing fluid, e.g. oil or gas. Generally, the sand screen comprises a perforated base layer or base pipe surrounded by a mesh material or other filter media disposed along the length of the base pipe. The filter media filters out sand, e.g. particulates and other solid materials, from the inflowing hydrocarbon fluid. After the hydrocarbon fluid passes through the filter media, the fluid enters the base pipe through the perforations disposed along the length of the base pipe. However, many conventional sand screen systems tend to be expensive to manufacture.

SUMMARY

In general, a system and methodology is provided for filtering sand. For example, a sand control system may be provided with a base pipe having a non-permeable section and a permeable section in which the permeable section is created via at least one opening formed laterally through a wall of the base pipe. The sand control system also comprises at least one drainage tube positioned along an exterior of the base pipe and coupled to the base pipe in fluid communication with the at least one opening. The drainage tube is permeable and enables the inflow of fluid while preventing the influx of sand. The inflowing fluid is delivered along an interior of the drainage tube and through the opening into an interior of the base pipe for production. Flow through the at least one opening also may be controlled via an inflow control device.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
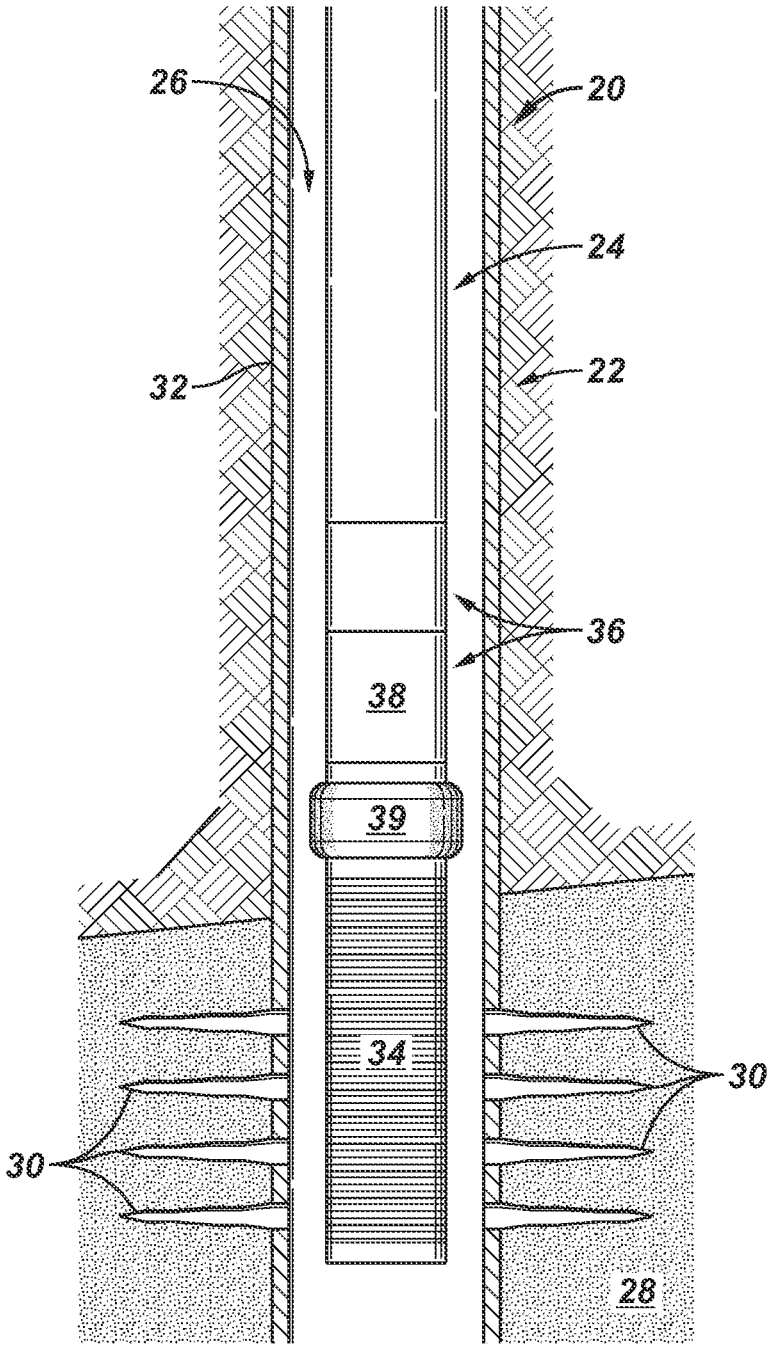
FIG. 1 is a schematic illustration of a well system comprising an example of a sand control system deployed in a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology for filtering sand from flowing fluid, such as from inflowing hydrocarbon fluid in a production well. As explained in greater detail below, the system and methodology also may be employed to control the inflow of fluid into a base pipe for production to a desired collection location. The design of the sand control system also allows the system to be manufactured at a substantially reduced cost compared to many conventional sand screen systems.

According to an embodiment, a well system is provided with a sand influx control system which also may be used to control the inflow of fluid, e.g. hydrocarbon fluid. In this example, the sand control system utilizes a base pipe having a non-permeable section which has a solid wall without perforations. The base pipe also comprises a permeable section which is permeable via at least one opening formed laterally through a wall of the base pipe. At least one drainage tube is positioned along an exterior of the base pipe and coupled to the base pipe in fluid communication with the at least one opening. The drainage tube is permeable and enables inflow of fluid into an interior of the drainage tube while preventing the influx of sand. The fluid flowing into the drainage tube interior moves along that interior and is directed to the at least one opening at the permeable section of the base pipe. The inflowing fluid flows from the drainage tube, through the opening, and into an interior of the base pipe for production.

By way of example, the drainage tube may serve the function of a screen by having openings through which fluids can pass while remaining small enough to block passage of sand. In some embodiments, the openings are distributed along the length of the drainage tube and the drainage tube is oriented to provide flow in the direction of the well along the length of the sand control system. The drainage tube is coupled with the base pipe to direct flow into the opening. In some examples, an inflow control device, e.g. an inflow control nozzle, is positioned in cooperation with the opening to control the inflow of fluid into an interior of the base pipe. In some examples, a plurality of drainage tubes and inflow control devices may be positioned around the base pipe to provide a desired throttling or other control over the fluid flowing into the base pipe.

Depending on the specifics of a given application, the sand control system may comprise a variety of arrangements, constructions, components, and/or cooperating components in many types of well strings or other tubular flow systems. For example, a plurality of drainage tubes may be coupled to the base pipe at different angles around a joint of the base pipe. At least one drainage tube may be coupled to the base pipe directly or via at least one housing assembly. The drainage tubes may be fastened to the base pipe via a plurality of techniques and mechanisms, including welding, brackets, and/or other fasteners. If brackets are used, the brackets also may be designed to centralize the base pipe within a casing or open wall of the wellbore. In some applications, a protective structure, such as a shroud, may be disposed around the drainage tube or tubes and the protective structure may be fastened to the drainage tube(s) to provide structural support. Additionally, the drainage tubes may have a variety of cross-sectional shapes including shapes that generally match the curvature of the base pipe and/or production tubing.

In some applications, the drainage tube may be constructed as a mesh tube. Additionally, the drainage tube may be constructed as a solid tube with slits or other openings sized to filter sand down to a desired particle size while allowing passage of fluid to an interior of the drainage tube. It should be noted that "sand" is used herein to generally indicate particulates which may include gravel, debris, and/or other types of particulates which are larger than a predetermined size. (The predetermined size may vary depending on the specific application.) The openings created by the mesh, slits, or other forms of openings serve as a filter media and may be varied along the length of the drainage tube to create different types of inflow profiles. For example, the drainage tubes may be designed to provide a higher inflow area towards an end of the drainage tube opposite the end which delivers fluid to the base pipe opening and the inflow control device.

Referring generally to FIG. 1, an embodiment of a system, e.g. a well system, for removing sand from a fluid and for controlling flow of the fluid is illustrated. By way of example, the system may comprise a sand control system coupled into a well string located in a wellbore. The sand control system and the overall well system may comprise many types of components and may be employed in many types of applications and environments, including cased wells and open-hole wells. The well system also may be utilized in vertical wells and deviated wells, e.g. horizontal wells.

Referring again to FIG. 1, a schematic example of a system 20, e.g. a well system for use in a well 22, is illustrated. Well 22 may comprise a production well for producing a desired fluid, e.g. gas or oil; and/or well 22 may comprise an injection well for injecting a desired fluid, e.g. gas or water. In the example illustrated, well system 20 comprises a well string 24 deployed in a wellbore 26 which extends through a formation 28. The formation 28 may be perforated via a plurality of perforations 30 and/or fractured to facilitate flow of hydrocarbon fluid into wellbore 26. In some applications, the wellbore 26 is lined with a casing 32, although the well string 24 may be deployed in an open wellbore. A sand control system 34 is illustrated as coupled into the well string 24 to facilitate removal of sand from the inflowing well fluid and to control the flow of well fluid into well string 24 for production to a collection location, e.g. a surface collection location. The sand control system 34 may be used in cooperation with a variety of other well string components 36, including artificial lift systems 38, e.g. electric submersible pumping systems, packers 39, completion components, and/or other well system components.

Figure 2:
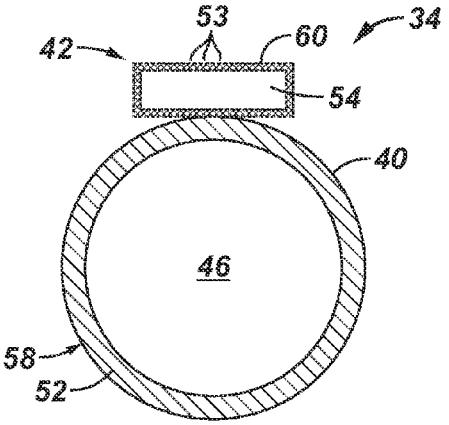
FIG. 2 is a cross-sectional view of an example of a sand control system, according to an embodiment of the disclosure.
Figure 3:
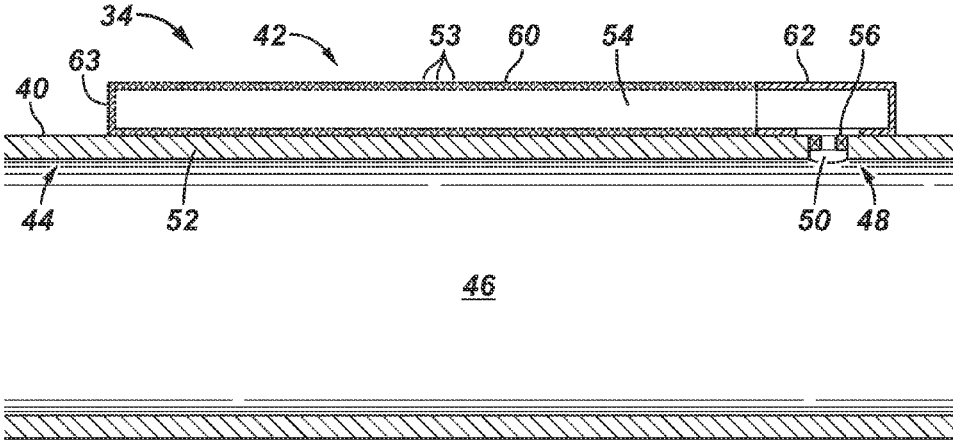
FIG. 3 is a schematic illustration of an example of a sand control system, according to an embodiment of the disclosure.

In FIGS. 2 and 3, an embodiment of sand control system 34 is illustrated. In this embodiment, sand control system 34 comprises a base pipe 40 and at least one drainage tube 42 coupled with the base pipe 40. The base pipe 40 comprises a non-permeable section 44 which is solid, i.e. without lateral openings, to prevent fluid flow from an external region to an interior 46 of the base pipe 40. The base pipe 40 also comprises a permeable section 48 having at least one opening 50 extending laterally, e.g. radially, through a wall 52 of the base pipe 40. In the example illustrated, opening 50 is in fluid communication with drainage tube 42 at, for example, an end of the drainage tube 42. It should be noted the drainage tube 42 is illustrated as having a rectangular cross-section although the drainage tube may be formed with other cross-sectional shapes, including triangular shapes, circular shapes, shapes matching the base pipe profile, and other suitable shapes.

The drainage tube 42 is designed with a permeable sidewall having a plurality of openings 53 through which fluid, e.g. well fluid, enters an interior 54 of the drainage tube 42. The drainage tube 42 is further designed to conduct fluid flow along the interior 54 of the drainage tube 42 to the permeable section 48 and through opening 50 into the interior 46 of base pipe 40. In some embodiments, an inflow control device 56 (ICD) is appropriately positioned and used in cooperation with opening 50 to control the flow of fluid from drainage tube 42 into base pipe 40. As explained in greater detail below, the sand control system 34 also may comprise a plurality of drainage tubes 42 coupled to a corresponding plurality of openings 50 used in cooperation with inflow control devices 56. A variety of inflow control devices 56 may be employed, and examples comprise ICD nozzles, tortuous flow ICDs, adjustable ICDs, autonomous ICDs, ICD nozzles with corresponding check valves, or other suitable types of ICDs.

As illustrated in FIGS. 2 and 3, the drainage tube 42 is positioned external to base pipe 40. For example, the drainage tube 42 may be positioned to extend longitudinally along an exterior surface 58 of base pipe 40 or along at least a substantial portion of the length of base pipe 40. Consequently, the interior 54 of drainage tube 42 is external to the outer diameter of the base pipe 40. In the example illustrated, the drainage tube 42 comprises a filter media 60 which, in turn, also comprises openings 53 to enable lateral flow of fluid into the interior 54 of drainage tube 42. In some embodiments, the filter media 60 is designed to extend along the longitudinal length of the drainage tube 42 or along a substantial portion of the longitudinal length of the drainage tube 42. The drainage tube 42 may be coupled to base pipe 40 via a housing 62 which routes fluid flow from interior 54 of drainage tube 42, through opening 50, and into the interior 46 of base pipe 40. The housing 62 may be constructed as a housing assembly which operates in cooperation with inflow control device 56. Additionally, the housing 62 and/or drainage tube 42 may be coupled to the base pipe 40 via a variety of suitable fastening techniques, including welds, fasteners, adhesives, brackets, or other suitable fastening techniques. In some applications, an opposite end of drainage tube 42 is at least partially capped with an end cap 63 to help ensure flow of fluid through filter media 60.

Figure 4:
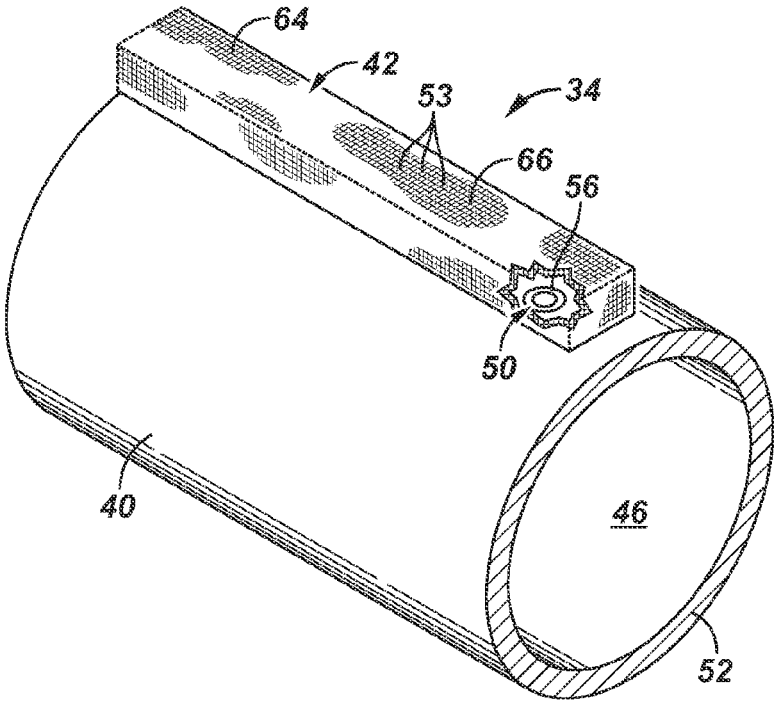
FIG. 4 is a schematic illustration of another example of a sand control system, according to an embodiment of the disclosure.

Referring generally to FIG. 4, another embodiment of the sand control system 34 is illustrated. In this example, sand control system 34 utilizes drainage tube 42 in the form of a mesh tube having a mesh tube section 64 in which the walls of the drainage tube 42 are formed with a mesh material 66. The mesh material 66 serves at least in part as filter media 60. By way of example, the mesh tube section 64 may be manufactured with sintered woven wire mesh having either single or multiple layers arranged to form the walls of the drainage tube 42 and to naturally create the openings 53 which allow lateral flow into drainage tube 42. The number of mesh layers and the construction of those layers may be selected according to the desired rigidity of the mesh tube section 64. The length of the mesh tube section 64 also may vary and may terminate at sheet material, e.g. sheet-metal used to form housing 62. In this embodiment, inflow control device 56 also may be used in cooperation with opening 50. As with the other embodiments described herein, the drainage tube 42 and the filter media 60 may be designed to extend substantially along the length of the base pipe 40 and sand control system 34.

Figure 5:
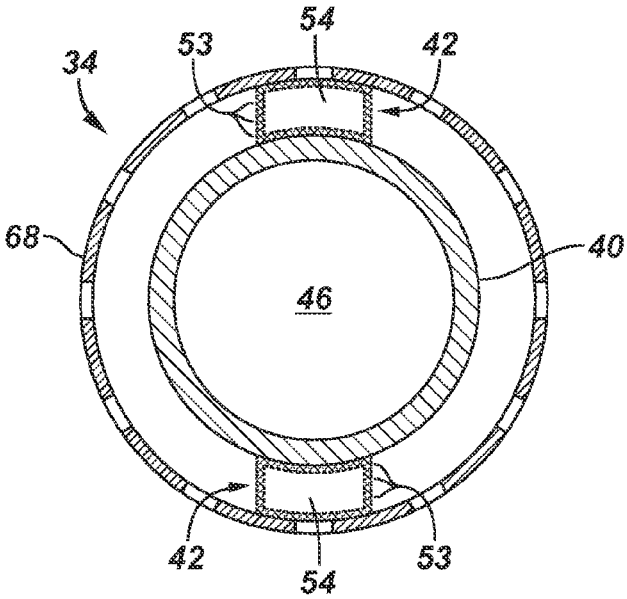
FIG. 5 is a schematic cross-sectional illustration of another example of a sand control system, according to an embodiment of the disclosure.

As discussed above, the sand control system 34 may utilize a plurality of drainage tubes 42 coupled to the base pipe 40 in cooperation with corresponding openings 50. In some embodiments, an inflow control device 56 is used in cooperation with each of the openings 50. In FIG. 5, an embodiment is illustrated in which two separate drainage tubes 42 are positioned along the exterior of base pipe 40 and are circumferentially spaced approximately 180° apart on the base pipe 40. In some applications, a protective structure 68 may be positioned around the drainage tubes 42 to protect the drainage tubes. The protective structure 68 may be employed with this embodiment and other embodiments described herein. By way of example, protective structure 68 may be in the form of a shroud coupled to the drainage tubes 42.

Figure 6:
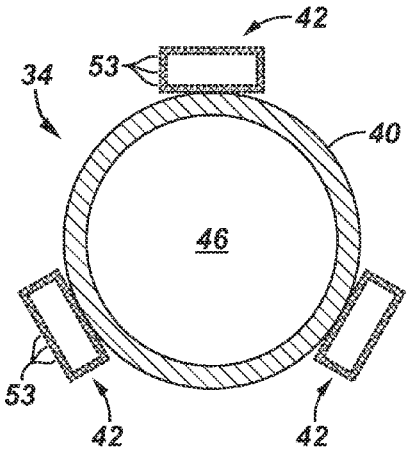
FIG. 6 is a schematic cross-sectional illustration of another example of a sand control system, according to an embodiment of the disclosure.
Figure 7:
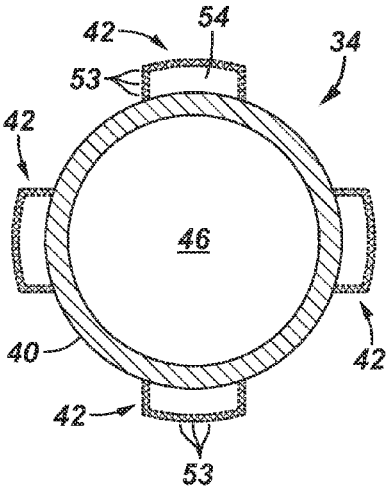
FIG. 7 is a schematic cross-sectional illustration of another example of a sand control system, according to an embodiment of the disclosure.

In another example, three separate drainage tubes 42 are positioned along the exterior of base pipe 40, as illustrated in FIG. 6. With multiple drainage tubes 42, the tubes may be circumferentially spaced according to the desired function of the overall sand control system 34. In the illustrated example, the three drainage tubes 42 are circumferentially spaced approximately 120° apart along the exterior surface 58 of base pipe 40. In FIG. 7, an embodiment is illustrated with four separate drainage tubes 42 that are circumferentially spaced around the exterior of base pipe 40. By way of example, the drainage tubes 42 may be circumferentially spaced at approximately 90° apart along the exterior surface 58 of base pipe 40. However, other numbers and arrangements of drainage tubes and corresponding openings 50 may be employed for a given sand control system 34. Additionally, the multiple drainage tubes 42 may be constructed to extend longitudinally along the base pipe 40 from one end of the base pipe 40 to the opposite end of the base pipe.

Figure 8:
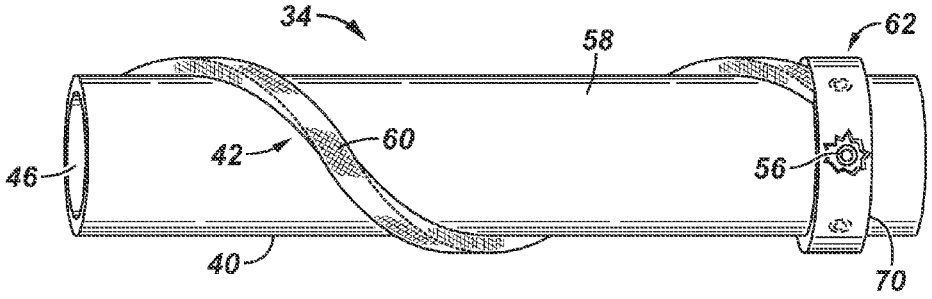
FIG. 8 is a schematic illustration of another example of a sand control system, according to an embodiment of the disclosure.

Referring generally to FIG. 8, another embodiment of sand control system 34 is illustrated. In this embodiment, the drainage tube 42 is wrapped around the base pipe 40. For example, the drainage tube 42 may be helically wrapped around the base pipe 40 from a first end of the base pipe 40 to a second end of the base pipe 40. In this embodiment, housing assembly 62 is formed as a concentric ring 70 disposed around the base pipe 40 at, for example, an end of the base pipe 40. The concentric ring 70 is designed to cover permeable section 48 of base pipe 40, and individual or plural openings 50 may be disposed beneath concentric ring 70 for communication with drainage tube 42. In some examples, inflow control devices 56 are disposed in the openings 50. Fluid entering the drainage tube 42 is directed along the interior 54 and into the interior of concentric ring 70 of housing assembly 62. The flow is then directed through the inflow control devices 56 and into interior 46 of base pipe 40. Although a single drainage tube 42 is illustrated, a plurality of the helically wrapped (or otherwise wrapped) drainage tubes 42 may be positioned along base pipe 40 and routed into cooperation with housing assembly 62 so as to direct fluid to the plurality of openings 50/inflow control devices 56.

In a well related operation, the sand control system 34 is run in hole on well string 24 and positioned adjacent formation 28. In some applications, the sand control system 34 may include or may be used in cooperation with packer 39 to isolate the wellbore region containing perforations 30. The sand control system 34 is anchored into the wellbore 26 to create an annulus between the base pipe 40 and the wall of the wellbore 26. In some applications, a gravel packing operation may be performed to place gravel in the annulus between the base pipe 40 and the wall of wellbore 26 adjacent the one or more drainage tubes 42. However, some applications may utilize the sand control system 34 without performing a gravel packing operation.

During production operations, well fluid flows from the formation 28, through perforations 30, and into the annulus surrounding base pipe 40. The well fluid flows into the drainage tube or tubes 42 as openings 53/filter media 60 remove sand from the well fluid. The filtered well fluid flows along the interior 54 of the drainage tube(s) 42 and to the permeable section 48 of base pipe 40. The fluid is then directed into the interior 46 of base pipe 40 through the corresponding opening or openings 50. In embodiments utilizing inflow control devices 56, the fluid flow is directed through the inflow control device which throttles or otherwise controls the flow of fluid into base pipe 40 for production to a desired collection location. For example, the fluid may be produced to a surface location for collection and/or further processing.

Figure 9:
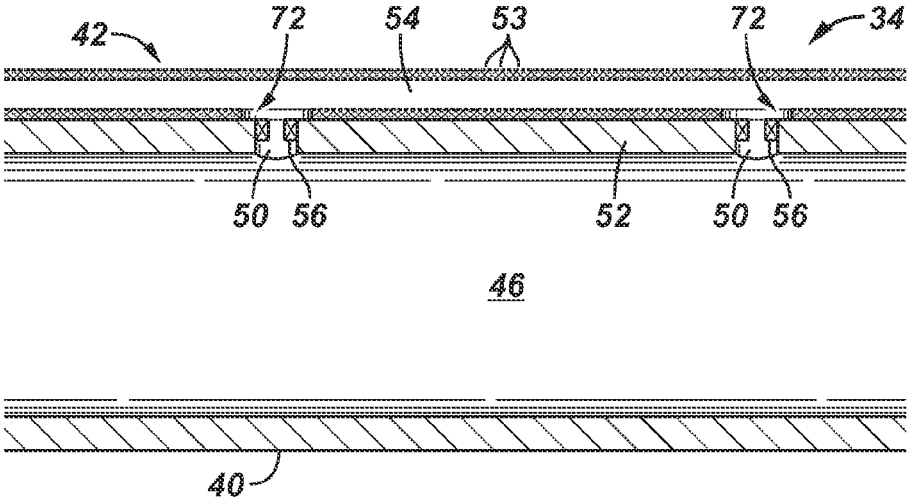
FIG. 9 is a schematic illustration of another example of a sand control system, according to an embodiment of the disclosure.

Referring generally to FIG. 9, another embodiment of sand control system 34 is illustrated in which openings 50 and inflow control devices 56 are distributed along a length of the base pipe 40. In this example, a single drainage tube 42 is illustrated as having a plurality of outlets 72 connected to the base pipe 40 to direct fluid through the corresponding openings 50 and inflow control devices 56. However, a plurality of separate drainage tubes 42 may be coupled with the base pipe 40 along its length and in fluid communication with the corresponding inflow control devices 56.

Figure 10:
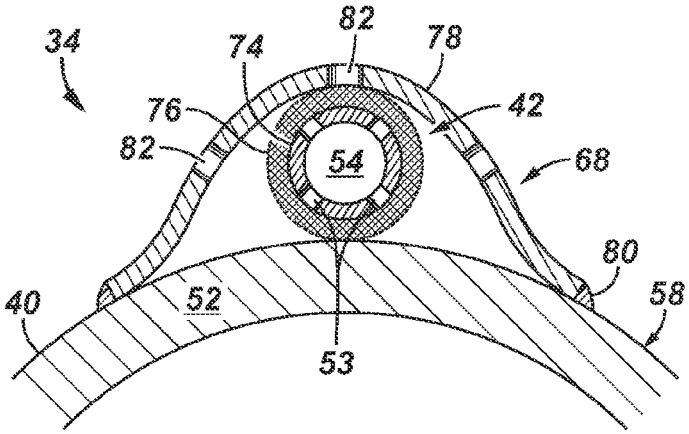
FIG. 10 is a schematic cross-sectional illustration of another example of a sand control system, according to an embodiment of the disclosure.
Figure 11:
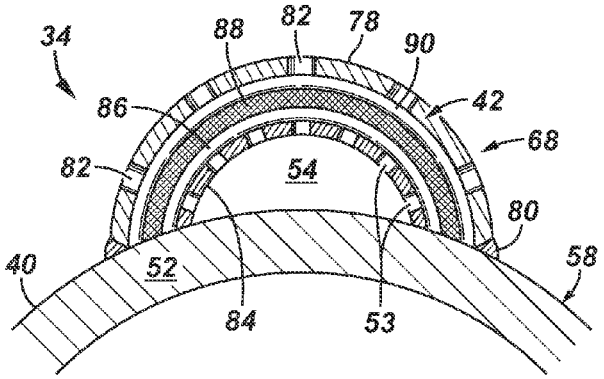
FIG. 11 is a schematic cross-sectional illustration of another example of a sand control system, according to an embodiment of the disclosure.

In FIGS. 10 and 11, additional embodiments are illustrated in which the drainage tubes 42 are combined with various protective features. In the embodiment illustrated in FIG. 10, for example, the drainage tube 42 comprises a relatively stiff, e.g. metal, inner tube 74 having a permeable structure via openings 53. The inner tube 74 is surrounded by a mesh tube 76, and the mesh tube 76 may be protected by the optional protective structure 68. In this example, protective structure 68 comprises a housing 78 disposed over the drainage tube 42 and connected to base pipe 40 by a suitable fastener 80, such as a weldment or other appropriate fastener. The housing 78 comprises a plurality of housing openings 82 which allow fluid flow to drainage tube 42.

In FIG. 11, the drainage tube 42 is formed such that its interior flow path 54 is bounded in part by the exterior surface 58 of base pipe 40. In this example, the drainage tube 42 comprises an inner permeable support structure 84 having openings 53. The inner permeable support structure 84 is covered by an inner drainage layer 86. Additionally, an internal mesh layer 88 serves as filter media 60 and is disposed between the inner drainage layer 86 and an outer drainage layer 90 positioned along an exterior of the mesh layer 88. This embodiment also may comprise protective structure 68 similar to the embodiment of FIG. 10, in which the protective structure 68 is formed with housing 78 having a plurality of openings 82 to enable flow of fluid to the interior 54 of the drainage tube 42. The protective structure 68 may be used to secure the other components of drainage tube 42 along the exterior of base pipe 40 by suitable fasteners 80.

Figure 12:
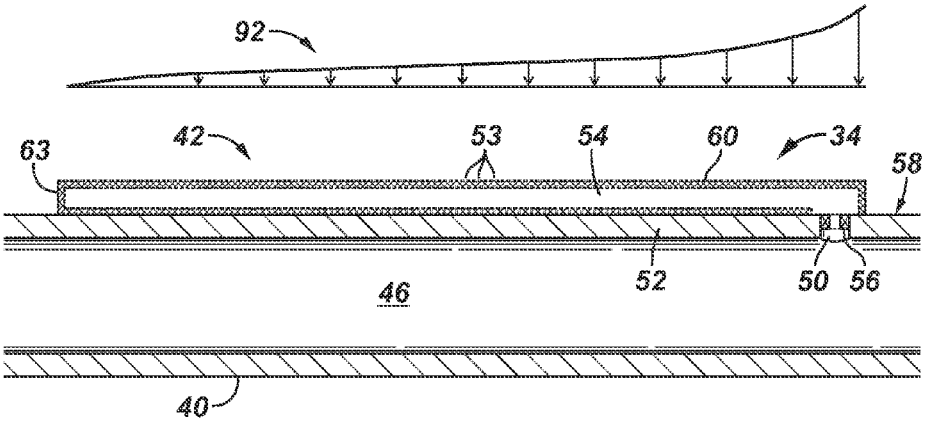
FIG. 12 is a schematic cross-sectional illustration of another example of a sand control system which has a changing inflow profile, according to an embodiment of the disclosure.

The pattern of openings 53 along drainage tube 42 may be changed along the length of the drainage tube to facilitate a controlled inflow of fluid to the interior flow path 54 of the drainage tube 42. For example, the openings 53 may have greater flow area at a position farther away from opening 50 and a more restricted flow area at a position closer to opening 50. In the graphical illustration of FIG. 12, the pattern of openings 53 is consistent along the length of the drainage tube 42 which results in increased fluid inflow along the drainage tube 42 moving towards opening 50, as indicated by graph 92.

Figure 13:
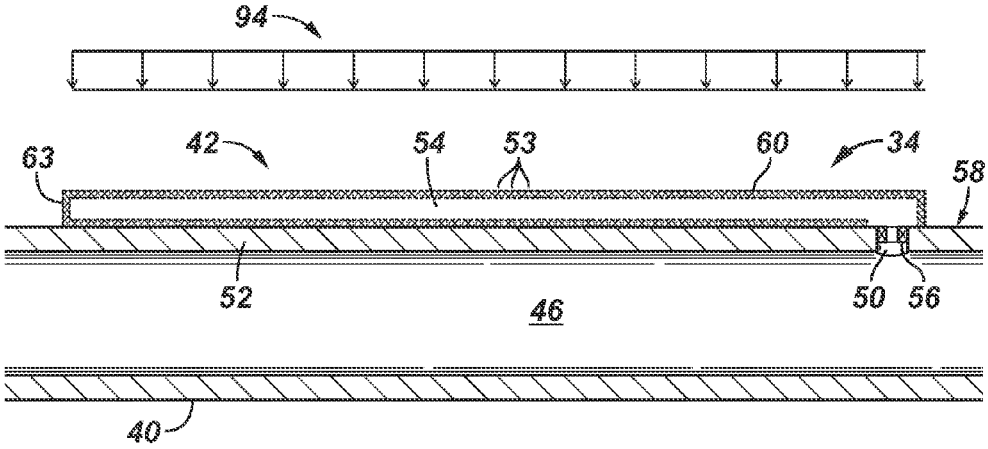
FIG. 13 is a schematic cross-sectional illustration of another example of a sand control system which has a generally constant inflow profile, according to an embodiment of the disclosure.

If, however, the pattern of openings 53 is modified to have a reduced inflow area moving towards opening 50 and an increased flow area moving toward the end of drainage tube 42 opposite opening 50, the inflow profile can be adjusted. In some applications, the pattern of openings 53 may be selected to establish a fairly uniform inflow profile along the drainage tube 42, as illustrated by graph 94 in FIG. 13. By way of example, the flow area can be increased or decreased by increasing or decreasing, respectively, the size and/or density of the openings 53. In some embodiments, the density of the mesh filter media 60 forming the drainage tube 42 and/or a separate filter media 60 may be constructed to control the flow profile. For example, a denser mesh located at a position towards the opening 50 decreases the flow area and restricts flow to the interior of drainage tube 42 in those areas.

Figure 14:
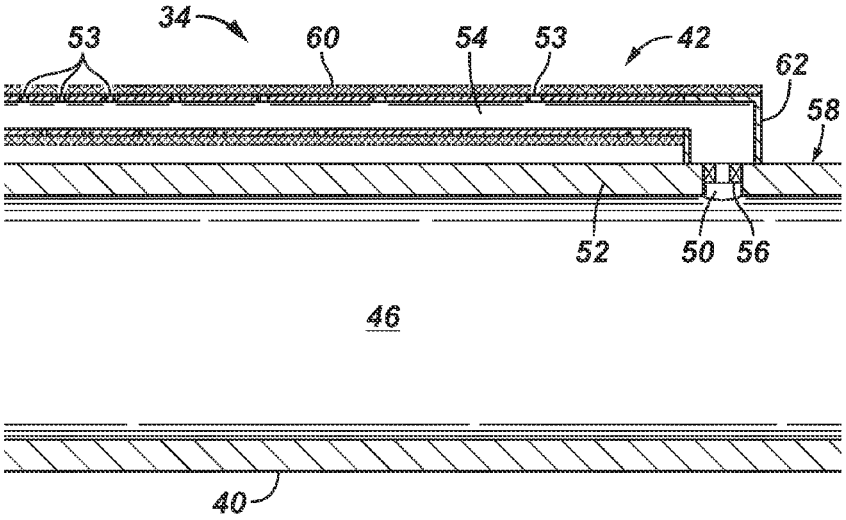
FIG. 14 is a schematic illustration of another example of a sand control system, according to an embodiment of the disclosure.

Referring generally to FIG. 14, an example of a drainage tube 42 having a changing flow area along its length is illustrated. In this embodiment, the drainage tube 42 is formed with inner tube 74 surrounded by filter media 60. However, the density of openings 53 through inner tube 74 increases along the length of drainage tube 42 moving in a direction away from opening 50 and inflow control device 56. This arrangement provides increased flow area into the interior 54 of drainage tube 42 at distances farther away from opening 50 and inflow control device 56. Such an arrangement of openings 53 establishes a predetermined flow area through the sidewall and into the interior 54 of drainage tube 42. The predetermined flow area can be used to provide a more even inflow profile (see profile 94 in FIG. 13) or to provide other desired flow profiles. Adjustments to the flow profile can be achieved via a variety of mechanisms, such as increased/decreased density of slits or other openings 53, differently sized openings 53, differing densities of filter media, and/or other techniques for adjusting the flow area into drainage tube 42 along the length of the drainage tube 42 to establish a desired inflow profile.

The overall system 20 may be constructed to accommodate a variety of flow filtering applications in many types of well environments and other environments in which sand removal and flow control are employed. Accordingly, the number, type and configuration of components and systems within the overall system may be adjusted to accommodate different applications. For example, the size, number and configuration of the sand control systems may vary from one application to another and may be combined with many types of well string equipment. In some applications, the sand control system 34 may be used in cooperation with a gravel pack placed in the wellbore, although other applications may employ the sand control system without a gravel pack. Additionally, some applications may utilize centralizers in cooperation with the sand control system 34 to position the sand control system at a desired radial position within the wellbore.

Additionally, many types of drainage tube configurations and drainage tube materials may be employed in constructing the drainage tubes. For example, the filter media 60 may be formed via openings through a relatively stiff tube, via formation of a mesh tube, via a filter material, e.g. a mesh material, placed over an inner perforated tube, and/or via other filtering mechanisms. Additionally, individual or plural drainage tubes may be combined with the base pipe. The base pipe also may be formed in a variety of sizes, lengths and configurations. The permeable section of the drain pipe may be concentrated at an individual circumferential location or at a plurality of locations along at least a portion of the length of the base pipe. Similarly, the size, number and/or configuration of the openings through the base pipe wall as well as the configuration of the inflow control devices may be adjusted according to the parameters of a given application.

The sand control system may be employed with a variety of packers or other seal systems to isolate specific regions of the wellbore. Depending on the types of fluids produced and the environment from which those fluids are produced, the components used in cooperation with the sand control system or systems may be adjusted. In some applications, for example, artificial lift systems may be positioned to receive the flow of fluid delivered to the interior of the base pipe from the drainage tube or tubes coupled to the bass pipe.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a base pipe having a non-permeable section and a permeable section, the permeable section formed by an opening extending laterally through a wall of the base pipe;

an inflow control device in communication with the opening;

a drainage tube coupled to the base pipe in fluid communication with an interior of the base pipe through the opening and the inflow control device, the drainage tube positioned along an exterior of the base pipe, and the drainage tube being permeable and comprising a mesh material which filters out sand from a production fluid flowing into the drainage tube, through the opening, and into the base pipe for production; and a protective shroud positioned at least partially around the base pipe, wherein the drainage tube is positioned between the base pipe and the protective shroud.

2. The system as recited in claim 1, wherein the opening comprises a plurality of openings and the drainage tube comprises a plurality of drainage tubes coupled to the base pipe in fluid communication with the plurality of openings.

3. The system as recited in claim 2, wherein the drainage tubes of the plurality of drainage tubes are spaced circumferentially around the base pipe.

4. The system as recited in claim 1, wherein the inflow control device is positioned at least partially within the opening to control flow into the base pipe through the opening.

5. The system as recited in claim 4, further comprising a housing disposed over the inflow control device, the drainage tube being coupled to the housing.

6. The system as recited in claim 1, wherein the drainage tube is helically wrapped around the base pipe.

7. The system as recited in claim 2, further comprising a protective structure positioned around the plurality of drainage tubes.

8. The system as recited in claim 1, wherein the permeability of the drainage tube changes along the length of the drainage tube.

9. The system as recited in claim 8, wherein the permeability is changed along the drainage tube by constructing the mesh material with openings providing a different flow area at different positions along the drainage tube.

10. The system as recited in claim 8, wherein the permeability is changed along the drainage tube by constructing the mesh material with-varying density.

11. The system as recited in claim 1, wherein the drainage tube further comprises an inner tube having one or more openings formed laterally therethrough, wherein the mesh material surrounds the inner tube, and wherein the inner tube and the mesh material are positioned between the base pipe and the protective shroud.

12. The system as recited in claim 1, wherein the drainage tube comprises:

a first tube having one or more openings formed laterally therethrough; and a second tube positioned radially-outward from the first tube, wherein the second tube comprises the mesh material, wherein a first drainage layer is positioned between the first and second tubes.

13. The system as recited in claim 12, wherein the protective shroud is positioned radially-outward from the second tube, and wherein a second drainage layer is positioned between the second tube and the protective shroud.

14. A method for producing hydrocarbons, comprising:

positioning a sand control system in a well string located in a wellbore, the sand control system comprising:

a base pipe;

an inflow control device in communication with an opening in the base pipe;

a drainage tube positioned along an exterior of the base pipe, wherein the drainage tube comprises a mesh material; and a protective shroud positioned around the base pipe, wherein the drainage tube is positioned between the base pipe and the protective shroud;

using the drainage tube to filter sand from a hydrocarbon fluid before the hydrocarbon fluid enters the base pipe; and directing the hydrocarbon fluid from the drainage tube, through the opening and the inflow control device, and into an interior of the base pipe for production up through the well string.

15. The method as recited in claim 14, wherein the drainage tube directs flow of the hydrocarbon fluid to an interior of the base pipe.

16. The method as recited in claim 14, further comprising providing the drainage tube with a capped end opposite the inflow control device.

17. The method as recited in claim 14, further comprising forming the drainage tube with an inflow profile that changes along the length of the drainage tube.

18. The method as recited in claim 17, wherein forming comprises forming the drainage tube to extend along at least a substantial portion of the length of the base pipe of the sand control system.

19. A sand control system, comprising:

a base pipe with an opening formed radially therethrough;

an inflow control device proximate the opening in the base pipe to control flow of fluid into an interior of the base pipe;

a drainage tube mounted along an exterior of the base pipe, the drainage tube comprising a mesh material disposed along a length of the drainage tube such that the drainage tube is permeable to a fluid, and the drainage tube having a tube end coupled to the base pipe to deliver the fluid from an interior of the drainage tube, through the inflow control device, and into the interior of the base pipe; and a protective shroud positioned around the base pipe, wherein the drainage tube is positioned between the base pipe and the protective shroud.

20. The sand control system as recited in claim 19, further comprising a well string into which the sand control system is mounted to filter sand from an inflowing hydrocarbon fluid.

* * * * *